US005711664A

United States Patent [19]

Jegou et al.

[11] Patent Number: 5,711,664

[45] Date of Patent: Jan. 27, 1998

[54] ROTARY MELTING FURNACE

[75] Inventors: Claude Jegou, Villelaure; Fayez Kassabji, Avon; Charley Renaux, Jouques, all of France

[73] Assignees: Commissariat A L'Energie Atomique; Electricite De France Service National, both of Paris, France

[21] Appl. No.: 681,062

[22] Filed: Jul. 22, 1996

[30] Foreign Application Priority Data

Aug. 3, 1995 [FR] France ..... 95 09462

[51] Int. Cl.[6] ..... F27B 7/38

[52] U.S. Cl. ..... 432/116; 432/103; 110/264

[58] Field of Search ..... 432/103, 116; 110/260, 262, 264

[56] References Cited

U.S. PATENT DOCUMENTS

| | | | |
|---|---|---|---|
| 2,702,743 | 8/1948 | Totzek | 110/264 |
| 3,510,115 | 5/1970 | Foex et al. . | |
| 3,703,277 | 11/1972 | Bosshard | 432/116 |
| 3,751,220 | 8/1973 | Rossi | 432/116 |
| 4,443,186 | 4/1984 | Shell | 432/103 |
| 4,785,746 | 11/1988 | Roy et al. | 110/262 |
| 4,836,775 | 6/1989 | Heithoff et al. | 432/103 |
| 5,515,794 | 5/1996 | Kassman et al. | 110/260 |

FOREIGN PATENT DOCUMENTS

| | | |
|---|---|---|
| 527701 | 10/1921 | France . |
| 2398261 | 2/1979 | France . |
| 2492274 | 4/1982 | France . |
| 2014127 | 8/1979 | United Kingdom . |

*Primary Examiner*—Henry A. Bennett
*Assistant Examiner*—Jiping Lu
*Attorney, Agent, or Firm*—Pearne, Gordon, McCoy & Granger LLP

[57] ABSTRACT

A rotary melting furnace having an enclosure supported for rotation. The enclosure includes a cylindrical shell, a pair of disc-shaped flanges connected to the shell at ends thereof, and a unitary liquid cooling circuit. The shell and the flanges each include a portion of the cooling circuit. The shell portion of the cooling circuit is connected to the flange portions of the cooling circuit by pipes.

7 Claims, 3 Drawing Sheets

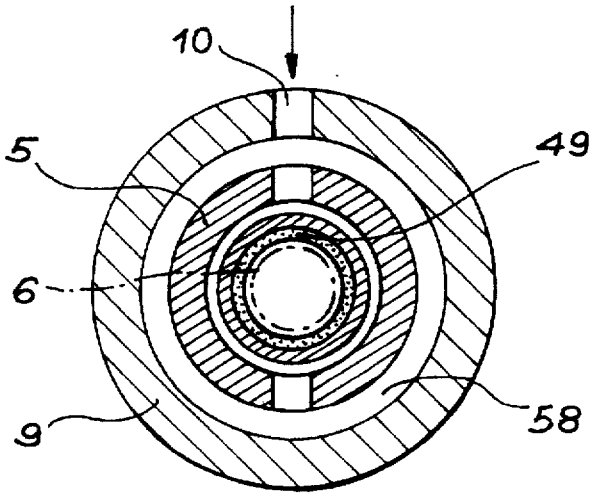
FIG. 3
FIG. 4
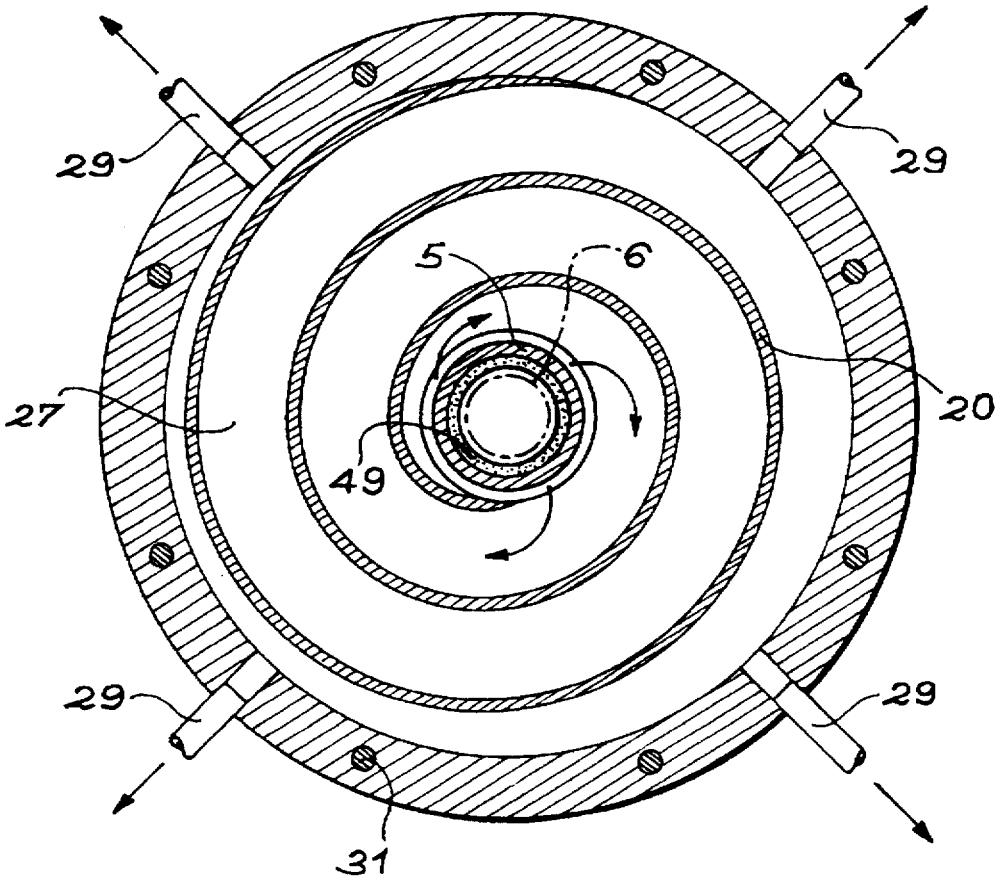

ROTARY MELTING FURNACE

The invention relates to a rotary melting furnace.

The melting of refractory products, such as zirconia and magnesia, which respectively melt at 2700° and 2800° C., imposes the use of special furnaces such as electric arc rotary furnaces. These furnaces comprise a cylindrical enclosure, whose axis is occupied by electrodes between which is struck the arc and said enclosure is rotated so that the material to be melted collects on the enclosure wall and protects the enclosure from excessive heating, forming what is called an auto-crucible, because it only melts for the surface layer giving onto the centre of the furnace and remains at lower temperatures towards the outer layers adjacent to the enclosure. However, the enclosure has to be cooled, despite this protection provided by part of the material to be melted.

It is formed from three parts in a known furnace, namely two disk-shaped, end flanges and a cylindrical shell joining them. The flanges are fixed and only the shell rotates, which makes it necessary to reestablish the continuity of the enclosure by intercalated joints. The flanges are bolted to a fixed, external shell, which surrounds the rotary shell and supports it by means of bearings. The gap between the shells forms a chamber allocated to the cooling of the inner shell. For this purpose use is made of a sprinkling circuit having a supply duct issuing at the top of the chamber, where it is terminated by sprinkling nozzles and a collecting duct issuing at the bottom of the chamber.

Therefore the chamber must be insulated at its longitudinal edges by gaskets in order to prevent leaks and protect the bearings.

As the flanges must also be cooled and precautions taken to prevent arc transfers along the enclosure, it is necessary to add two cooling circuits and numerous electrical insulation and sealing joints between the inner shell and the flanges on the one hand and the outer shell and other fixed parts of the installation on the other. The layout of the furnace then becomes very complicated.

The object of the invention is to simplify rotary melting furnaces, particularly with regards to the devices linked with their support on a fixed frame, their cooling and the layout of the electrical insulation joints subdividing them into several parts.

SUMMARY OF THE INVENTION

The inventors have found that these objects can be achieved by making the shell integral with the flanges and by providing a single cooling circuit for the flanges and the shell, despite the difficulties in ensuring a correct flow along said complex shaped, large surface enclosure, which imposes high pressure drops.

In its novel design, the furnace can be supported from the flange by which the arc enters by means of a hollow shaft giving passage to one of the electrodes and the cooling circuit can be terminated at said shaft. The sealing and cooling liquid supply devices are transferred at this location out of the enclosure and the furnace is then greatly simplified.

The circulation of cooling liquid can be facilitated by giving the circuit a shape or an orientation permitting, on rotating the furnace, to propel the liquid in the flow direction by inertia forces. It is therefore possible to promote a spiral flow in the flanges and a helical flow along the shell.

The cooling circuit is advantageously hollowed from the flanges and shell and assumes the form of a countercurrent circuit, where the liquid circulates in the furnace forming two superimposed layers. In practice, the flanges and shell are generally produced separately and assembled and it would be difficult to connect the portions of the cooling circuit of these parts without adding gaskets or seals, which would be subject to a high temperature and would again complicate the layout. It is therefore probably better for the cooling circuit portions to issue onto the outer face of the enclosure, without being interconnected, and being joined by pipes which pass round the connections of the shell to the flanges.

BRIEF DESCRIPTION OF THE DRAWINGS

The invention is described in greater detail hereinafter relative to nonlimitative embodiments and the attached drawings, wherein show:

FIG. 3 A detail of FIG. 1 in section III—III.

FIG. 4 A detail of FIG. 1 in section IV—IV.

DETAILED DESCRIPTION OF THE PREFERRED EMBODIMENTS

Figure 1:
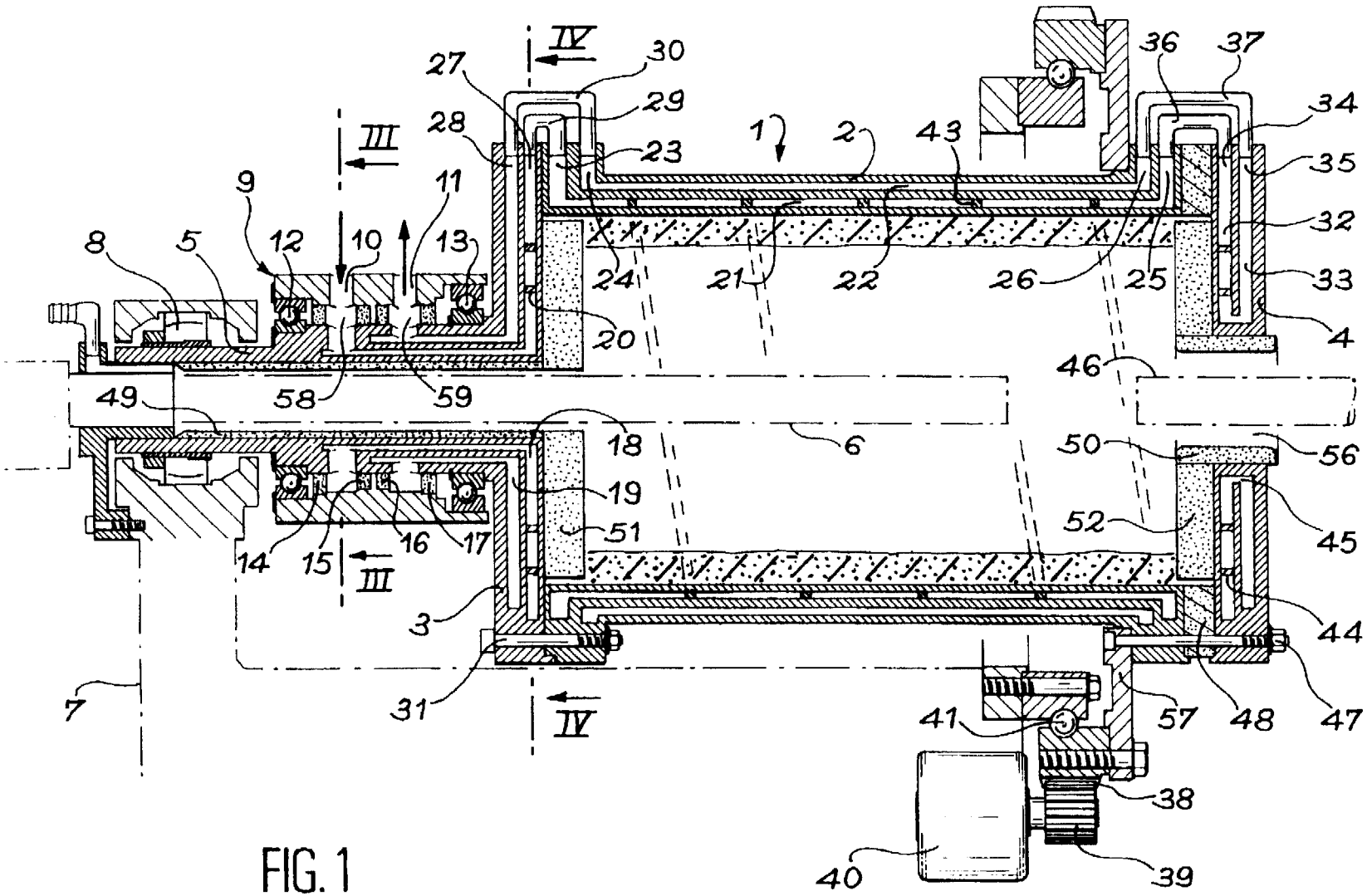
FIG. 1 A view of an-embodiment of the invention.

Comment will firstly be made on FIG. 1. The essence of the structure of the furnace is formed by an enclosure 1 constituted by a cylindrical shell 2 joined to a support flange 3 and a casting or pouring flange 4, both being in disk form. The support flange 3 is extended by a hollow shaft 5, coaxial to the shell 2 and which is occupied by an electrode 6 extending over a considerable part of the length of the enclosure 1, along the axis thereof and transferring the melting arc to another electrode 46, which traverses the pouring flange 4 at the location of a central taphole 56. The arc radiates towards the material to be melted, which covers the inner face of the shell 2 in operation, when he enclosure 1 rotates. The second electrode 46 is withdrawn prior to the discharge of the molten material from the enclosure 1.

The shaft 5 is supported by a frame 7 by means of a bearing 8. It is surrounded by a ring-type cooling liquid collecting and distributing box or case 9, traversed at its top by a supply duct 10 and by a collecting duct 11. The box 9 is supported at its axial ends by a pair of bearings 12 and 13 joining it to the hollow shaft 5. Two pairs of joints 14, 15 and 16, 17 extend between the shaft 5 and the box 9 and, surrounded by the bearings 12, 13, insulate the collecting and supply ducts 11, 10 respectively from one another and from the bearings 12 and 13.

The enclosure 1 is formed by three solid layers separated by superimposed channels forming the cooling circuit. In reality, these channels form a single channel throughout the enclosure 1. Thus, in the support flange 3 is hollowed a supply channel 18 and a collecting channel 19, which are joined, planar and circular and extended by annular, concentric portions in the shaft 5. However, whereas the collecting channel 19 is completely free, the supply channel 18 is partly occupied In the flange 3 by a spiral 20 (visible in FIG. 4), which transforms it into a spiral channel in which a centrifugal flow of the cooling liquid is ensured as a result of the rotation direction of the enclosure 1. The supply 18 and collecting 19 channels are terminated in the hollow shaft 5 by adjacent, circular grooves 58, 59 into which respectively issue the supply 10 and collecting 11 ducts. No matter what the position of the enclosure 1, the circulation of cooling water is consequently uninterrupted during rotation. This construction is clearly shown in FIG. 3.

In the shell 2 is hollowed out a supply channel 21 and a return channel 22, which are concentric and annular. The return channel 22 is completely free, but the supply channel 21 is occupied by a helix 43, which transforms it into a helical channel, where the cooling liquid imposes a flow directed towards the pouring flange 4 when the enclosure 1 rotates.

The supply 21 and return 22 channels do not extend to the end of the shell 2, but are instead terminated by orifices 23, 24 respectively on the side of the support flange 3, and 25, 26 respectively on the side of the pouring flange 4. All these orifices 23 to 26 have a radial direction and consequently form bends with the channels 21 and 22.

Thus, the orifices 22 and 24 issue onto the outer face of the enclosure 1 alongside orifices 27, 28 of the supply 18 and collecting 19 channels of the support flange 3. Curved pipes 29, 30 are then provided for respectively connecting orifices and 27 and orifices 24 and 28. As a result of this arrangement, the shell 2 can be assembled with the support flange 3 by bolts 31, without taking any special precautions and without it being necessary to provide complicated sealing systems.

The pouring flange 4 is itself provided with a supply channel 32 and a return channel 33 having respective orifices 34, 35 issuing at its periphery and alongside the or orifices 25, 26. It is then merely necessary to add other curved pipes 36, 37 respectively between orifices 25, 34 and between orifices 26, 35, to ensure that the cooling circuit is perfectly unified between the supply 10 and collecting 11 ducts, the supply and return channels 32, 33 respectively being connected at a junction 45 around the taphole 56.

In the same way as for the other portions of the enclosure 1, the return channel 33, which is planar and circular, is completely freed, whereas the also planar, circular supply channel 32, parallel to the channel 33, is occupied by a spiral 44, which imposes a centripetal movement on the cooling liquid when the enclosure 1 rotates. Therefore its orientation is opposite to that of the spiral 22 of the support flange 3.

A clamp 57 is connected to the shell 2, close to the pouring flange 4, by bolts 47 and carries a bevel gear 38, which meshes with a pinion 39 of a motor 40 fixed to the frame 7. Moreover, a bearing 41 is placed between the clamp 57 and the frame 7. Thus, the bearings 8 and 41 perfectly support the assembly constituted by the enclosure 1 and the hollow shaft 5 extending it, by its two ends. The motor 40 rotates the enclosure 1 by means of the bevel gear 38 and the 57.

The bolts 47 are also used for assembling the pouring flange 4 with the shell 2. They are insulating bolts, because it is wished to establish a barrier to flows of electricity and arcing between said two parts. For this purpose intercalation takes place of an insulating, circular lining 48, which is compressed by the bolts 47, between the facing faces of the shell 2 and the pouring flange 4. The curved tubes 36 and 37 are also insulating, in the same way as the cooling water, because it is demineralized. It has been found that no insulating joint is necessary in practice, which differs greatly the known furnace, even though it is here again necessary to have insulating sleeves 49, 50 in the hollow shaft 5 and the taphole 56 in order to ate said parts from the electrodes 6 and 46, and insulating disks 51, 52 covering the inner faces of the flanges 3, 4, so that they do not fix the arc.

Figure 2:
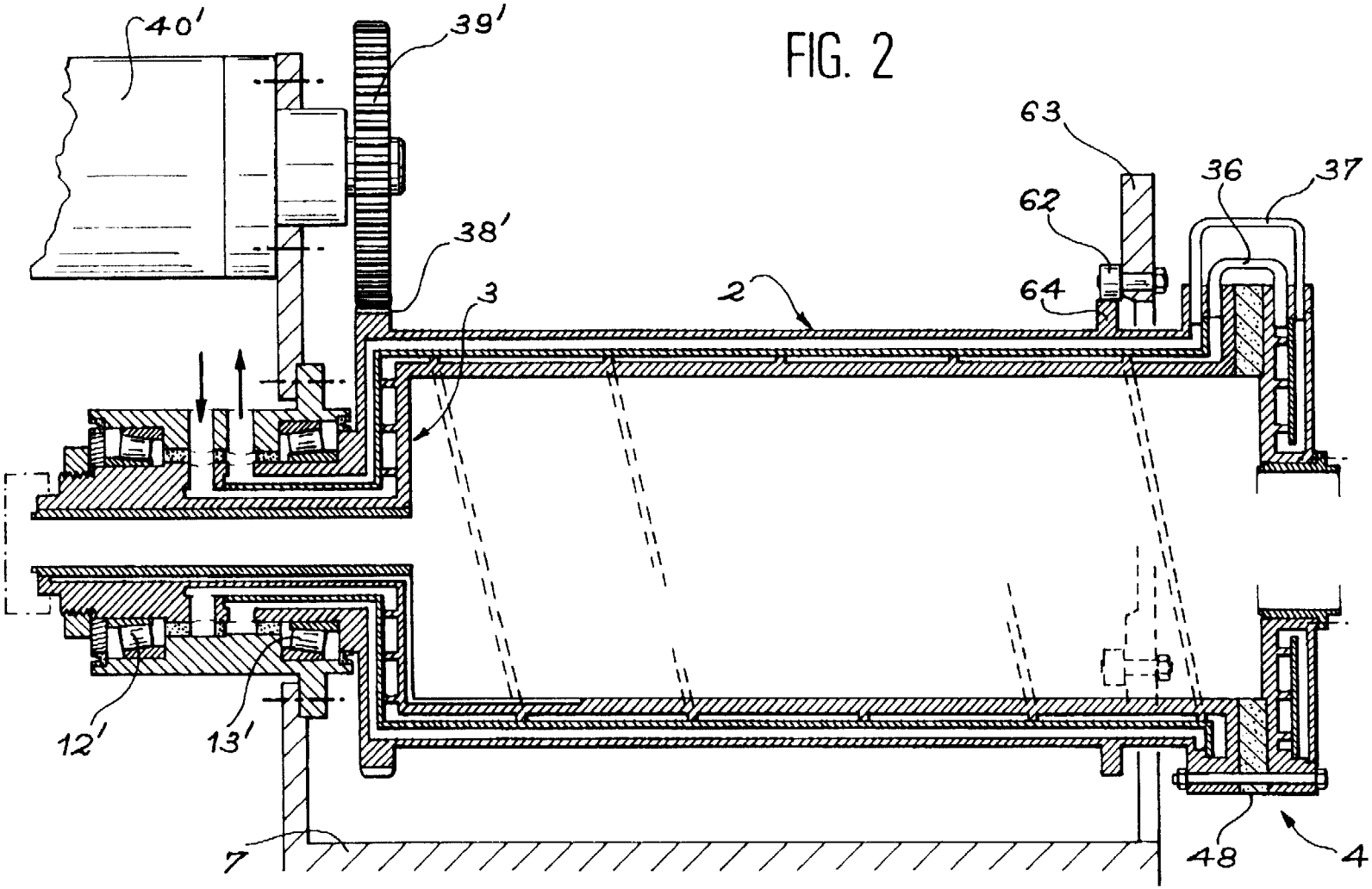
FIG. 2 A view of another embodiment.

FIG. 2 illustrates somewhat different layout. The electrodes 6, 46 and the insulating disk 51, 52 have been omitted to facilitate understanding.

The motor 40 is displaced and takes the reference 40', being located close to the hollow shaft 5 and its pinion 39' meshes with a bevel gear 38' on the periphery of the support flange 3. The latter is in one piece with the shell 2 and their supply channels 18 and 21 and their collecting 19 and return 22 channels communicate directly without an orifice or connection with the outside. The pouring flange 4 remains separated from the shell 2 by a circular, insulating lining 48 and thus there are once again curved pipes 36, 37 for connecting their channels.

The bearing 41 has disappeared and is replaced by a series of rollers 62 mounted on a ring 63, which rises from the frame 7 and surrounds the shell 2 close to the pouring flange 4, towards the location where the clamp 57, which has also disappeared, was located. However, it is possible to add to the shell 2 a collar 64 for supporting the rollers 62.

The box 9 supports the hollow shaft 5 and enclosure 1, being screwed to the frame 7. The bearings 12 and 13 must now support a greater weight and are advantageously replaced by stronger bearings, such as the roller bearings 12' and 13'.

Mention has only been made of electrical heating by coaxial electrodes 6 and 46. Other heating modes are compatible with the invention, such as gas or plasma torches, heating elements by the Joule effect, inductors or wave guides. The hollow shaft 5 can be replaced by a solid shaft in certain of the solutions, the heating device being introduced through the taphole 56. The frame 7 is designed so as to tilt on pouring and lowers the taphole 56.

We claim:

1. A rotary melting furnace comprising:

an enclosure having a cylindrical shell, first and second disc-shaped flanges connected to the shell at ends thereof, and a liquid cooling circuit; a support for supporting the enclosure; and a motor for rotating the enclosure about an axis when a melting process occurs; and wherein the cooling circuit is unitary, and the shell includes a shell portion of the cooling circuit and the first and second flanges respectively include first and second flange portions of the cooling circuit.

2. A rotary melting furnace according to claim 1, wherein the cooling circuit is configured to impart a flowing movement to liquid in the cooling circuit when the enclosure is rotated; and wherein the shell portion of the cooling circuit includes a helical channel and at least one of the first and second flange portions of the cooling circuit includes a spiral channel.

3. A rotary melting furnace according to claim 2, wherein the cooling circuit has an inlet and an outlet near the first flange; and wherein the shell portion and the first and second flange portions of the cooling circuit each have an inlet layer and an outlet layer in which generally opposite flows of liquid are imparted, the inlet layer in the shell portion comprising the helical channel and the inlet layer in the second flange portion comprising the spiral channel.

4. A rotary melting furnace according to claim 3, wherein the inlet layer of the first flange portion comprises a spiral channel which is wound oppositely to the spiral channel in the second flange portion; and wherein the outlet layer in the shell portion and the outlet layers in the first and second flange portions are free, the outlet layers in the first and second flange portions being circular and the outlet layer in the shell portion being annular.

5. A rotary melting furnace according to claim 3, further comprising: a shaft extending from the enclosure, and stationary inlet and outlet liquid ducts; and wherein the inlet and outlet layers in the first flange portion comprise annular concentric channels disposed around the shaft, said inlet and outlet liquid ducts terminating adjacent to the annular concentric channels.

6. A rotary melting furnace according to claim 5, further comprising first and second electrodes, said first electrode being at least partially contained in the shaft and extending into the enclosure through the first flange, and said second electrode extending into the enclosure through the second flange; and wherein the second flange is connected to the shell by an insulating gasket and insulating bolts.

7. A rotary melting furnace according to claim 1, wherein the shell portion and the first and second flange portions of the cooling circuit each comprise ending ports respectively extending through outside surfaces of the shell and the first and second flanges; and wherein the cooling circuit further comprises pipes connecting the ending ports of the shell portion to the ending ports of the first and second flange portions, said pipes extending across the junctures of the shell and the first and second flanges.

* * * * *

UNITED STATES PATENT AND TRADEMARK OFFICE

CERTIFICATE OF CORRECTION

PATENT NO. : 5,711,664

DATED : January 27, 1998

INVENTOR(S) : Jegou et al.

It is certified that error appears in the above-identified patent and that said Letters Patent is hereby corrected as shown below:

Column 1, line 2, under the title ROTARY MELTING FURNACE, insert the centered title --BACKGROUND OF THE INVENTION--.

Column 2, line 18, delete "an-embodiment" and insert --an embodiment--.

Column 2, line 58, delete "In" and insert --in--.

Column 3, line 14, delete "orifices 22 and 24" and insert --orifices 23 and 24"--.

Column 3, line 18, delete "and 27 and orifices 24 and 28." and insert --23 and 27 and orifices 24 and 28.--.

Column 3, line 25, delete "or" at the end of line 25.

Column 3, line 47, delete "57." and insert --clamp 57.--.

Column 3, line 57, delete "insulating joint" and insert --other insulating joint--.

UNITED STATES PATENT AND TRADEMARK OFFICE

CERTIFICATE OF CORRECTION

PATENT NO. : 5,711,664

DATED : January 27, 1988

INVENTOR(S) : Jegou et al.

It is certified that error appears in the above-identified patent and that said Letters Patent is hereby corrected as shown below:

Column 3, line 58, delete "the known furnace," and insert --from the known furnace,--.

Column 3, line 60, delete "ate" and insert --insulate--.

Column 3, line 63, delete "illustrates somewhat" and insert --illustrates a somewhat--.

Signed and Sealed this

FourthDay of August, 1998

Bruce Lehman

*Attest:*

BRUCE LEHMAN

*Attesting Officer*

*Commissioner of Patents and Trademarks*